US005436414A

United States Patent [19]

Hodkin et al.

[11] Patent Number: 5,436,414

[45] Date of Patent: Jul. 25, 1995

[54] DRIVE MECHANISM FOR CIRCUIT INTERRUPTERS

[75] Inventors: George A. Hodkin; David G. Roberts; Trevor B. Marshall, all of Nottingham, England

[73] Assignee: Eaton Corporation, Cleveland, Ohio

[21] Appl. No.: 93,288

[22] Filed: Jul. 16, 1993

[51] Int. Cl.[6] ..... H01H 33/66

[52] U.S. Cl. ..... 200/17 R; 218/84; 218/118

[58] Field of Search ..... 200/17 R, 144 R, 144 B, 200/148 R, 148 F

[56] References Cited

U.S. PATENT DOCUMENTS

| | | | |
|---|---|---|---|
| 3,898,407 | 8/1975 | Hodgson | 200/144 B |
| 4,376,235 | 3/1983 | Milianowicz | 200/50 AA |
| 4,384,179 | 5/1983 | Milianowicz | 200/50 AA |
| 4,654,494 | 3/1987 | Wüthrich | 200/337 |
| 4,996,397 | 2/1991 | Kuhn et al. | 200/144 B |
| 5,055,640 | 10/1991 | Lippi et al. | 200/144 B |

*Primary Examiner*—A. D. Pellinen
*Assistant Examiner*—Michael A. Friedhofer
*Attorney, Agent, or Firm*—Martin J. Moran

[57] ABSTRACT

A drive mechanism for a circuit interrupter comprising a crank and lever pivotally interconnected by a resiliently yielding connecting rod assembly. The connecting rod assembly comprises a coil compression spring and first and second links slidably coupled together to compress the coil compression spring. Rotation of the crank in either direction causes the lever to drive the movable contact of the circuit interrupter into and out of engagement with the stationary contact. The coil compression spring is loaded under compression when the movable contact is driven into engagement with the stationary contact, storing and maintaining a mechanical static load on the movable contact for as long as the movable contact is engaged with the stationary contact.

16 Claims, 4 Drawing Sheets

DRIVE MECHANISM FOR CIRCUIT INTERRUPTERS

The present application is related to, concurrently owned and concurrently assigned an application entitled "Cradle Assembly for Circuit Interrupters", by inventors George A. Hodkin, David G. Roberts, and Trevor B. Marshall (attorney docket no. WE 57,653) and an application entitled "Flexible Connector for Circuit Interrupters", by inventor Antonio I. Takiishi (attorney docket no. WE 57,200).

BACKGROUND OF THE INVENTION

1. Field of the Invention

The invention relates to the field of mechanisms for making and breaking electrical circuits, and in particular concerns a mechanism that drives a circuit interrupter between open and closed positions and that has a resiliently yielding connecting rod for maintaining a predetermined closing pressure as the contacts of the interrupter erode with use.

2. Prior Art

Drive assemblies are known that transmit the drive force of an external drive mechanism to bring together or to separate paired contacts forming a circuit interrupter. A circuit interrupter for a single conductor ordinarily comprises a stationary contact and a movable contact. The mechanical force for driving the interrupter typically is supplied via a rotatable drive shaft, the motion of which is arranged to relatively displace the contacts linearly, e.g., along a longitudinal axis of opposed conductor stubs that meet endwise. A plurality of interrupters can be coupled to the same drive shaft or connected by linkages, for gang operation in which the contacts for a number of conductors are opened or closed as a unit.

In a typical drive assembly, rotation of the drive shaft through part of a revolution drives the movable contact linearly into and out of engagement with the stationary contact. In this manner the circuit interrupter is respectively closed and opened. Known interrupter drive assemblies have certain problems, particularly when the circuit interrupters are used in demanding applications. An example is a circuit interrupter used in an electrical power substation. A circuit interrupter for a substation may typically carry a line voltage of 15 KV. The line has an inductance, and can be coupled to various inductive loads. When the contacts are closed, electric current is free to flow across the engagement between the movable and stationary contacts. However, the flow of current across the contacts produces a repelling force that acts to urge the contacts away from one another. It is known, for example, that the movable and stationary contacts for circuit interrupters employed in 15 KV substations should be mechanically retained in engagement by virtue of a positive static load of 900 or so pounds, to overcome the current-induced repulsion between the contacts. This is a substantial load, and complicates the structure of the mechanism needed to make and break the contacts.

The need to include a biasing force for holding the contacts together, and the structure needed to do this, are subject to another problem involving the erosion of the surfaces of the contacts due to arcing. In air, contact surfaces erode during each high current interruption as a plasma arc bridges across the opening space between the contacts. It is possible to confine the contacts in a vacuum receptacle to reduce the arcing problem. However, some erosion of the contact surfaces still occurs. The interrupter is advantageously designed to be reusable for making and breaking the circuit over many repetitions. After repeated interruptions, however, erosion shortens the contacts to the point that they need to be repaired or replaced for continued dependable operation. For example, in a typical structure after the contacts lose about 3 millimeters or so from their surfaces as measured in the direction of relative advance or retraction, they need to be replaced or the interrupter may not operate dependably to maintain the necessary static load.

The interrupter drive assembly is designed with a particular stroke length in mind. The erosion of the contact surfaces changes the dimensions of the apparatus, and affects the performance of the drive assembly. The outer limits of travel of the drive mechanism are generally limited by mechanical stops, and the retracted position of the contacts may also be limited by a mechanical stop. However, the advanced position of the contacts varies with their erosion. Thus, for example, the angular displacement of the drive shaft encompasses a full preset range and does not vary. With the circuit interrupter contact, however, a contact structure that was arranged to travel back and forth about 14 millimeters or so relative to the stationary contact when new, may have to travel 17 to 20 mm between the point at which its surface bears on the stationary contact and the retracted position of the movable contact, normally fixed by the structure.

Thus, the reversible input motion to the drive assembly has a set stroke, but the reversible output motion applied to the contacts must vary over time to account for the additional gap length due to contact erosion. One of the design objects of an interrupter drive assembly is to compensate for the variance between the relatively unchanging input stroke and the need for a gradually increased output stroke. This must be done while retaining a structure that will apply a substantial force to the contacts when they are closed, to overcome electromagnetic repulsion.

It would be desirable to improve on known interrupter drive assemblies to find an optimal solution to the contact pressure and changing stroke length problems. Such a device advantageously would maintain a predetermined static mechanical load on the movable contact when the movable contact is engaged against the stationary contact, which load does not decrease substantially due to a change of contact stroke length. Therefore, the device should maintain the load in a manner that compensates for the increasing variance between the input and output motion as the contact surfaces erode away. These requirements could advantageously be provided in an improved drive assembly characterized by better performance, simplicity, and reliability than known interrupter assemblies.

SUMMARY OF THE INVENTION

It is an object of the invention to provide a mechanism for transmitting an input driving force to a movable contact of a circuit interrupter.

It is another object of the invention to provide a drive mechanism that couples a rotating drive input mechanism with a reciprocating drive output mechanism such as the movable contacts of a circuit interrupter.

It is another object of the invention to provide a drive mechanism that includes a resiliently yielding connecting rod between a crank and a lever.

It is another object of the invention to provide a drive mechanism that can store and maintain a mechanical static load on the movable contact of the circuit interrupter while the movable contact is engaged with the stationary contact.

It is another object of the invention to provide a drive mechanism that compensates for the variance between the relatively unchanging input span of motion and a gradually increasing output span of motion resulting from the contact surfaces gradually wearing away, while retaining good contact pressure in the closed position.

These and other objects are accomplished by a drive mechanism that includes a crank coupled to the drive shaft, a lever coupled to the movable contact, and a resiliently extendible connecting rod assembly between the crank and the lever. The crank rotates around the drive shaft, and carries a pivot point or linkage for one end of the connecting rod assembly through part of a revolution around the axis of the drive shaft. The lever rotates on a pivot post spaced from the drive shaft and fixed on a base or mounting structure. The lever has three pivot couplings, namely one for the opposite end of the connecting rod assembly, a second for the pivot post fixed on the mounting structure, and a third for the pivotal interconnection of the lever with the reciprocating contact of the circuit interrupter.

The connecting rod assembly is arranged to telescope against the spring bias of a coil compression spring. The connecting rod assembly has a first link, a second link slidable longitudinally relative to the first, and a coil compression spring that is arranged between protruding abutments of the first and second links. The first link has a pivot point at which the first link is pivotally attached to the crank and a spaced abutment surface opposed to the pivot point of the first link. The second link has a pivot point at which the second link is pivotally attached to the lever and a spaced abutment surface opposed to the pivot point of the second link. The first and second links of the connecting rod assembly partly overlap one another such that each abutment surface both opposes the other abutment surface and engages one of the opposite ends of the coil compression spring.

A rotational drive force is applied to the crank by the drive shaft. Clockwise and counterclockwise rotation of the crank causes the lever to drive the reciprocating movable contact into and out of engagement with the stationary contact. The connecting rod assembly transmits a tension load as the reciprocating contact is driven into and maintained by this tension load in engagement with the stationary contact.

The coil compression spring is resiliently compressible under such tension load for storing and maintaining a mechanical static load of a selected amount on the reciprocating contact while the reciprocating contact is engaged with the stationary contact. The coil compression spring also compensates for the variance between the relatively unchanging input motion (via the crank) and the gradually increasing output motion resulting from the contacts gradually wearing away.

The connecting rod assembly defines a sliding coupling between the first and second links. The sliding coupling generally comprises an elongated slot recessed through the first link and a sliding pin supported by the second link disposed in the slot. The sliding pin additionally interconnects the second link with the lever in a pivotable engagement. As the connecting rod assembly is loaded under tension, the coil compression spring resiliently compresses and the connecting rod assembly correspondingly extends.

The coil compression spring is structured and dimensioned such that sufficient load force is applied with regard to the spring constant of the compression spring, that the contact engagement force remains above a predetermined minimum when the contacts have eroded to their useful maximum. However, as a result of the compression spring, the allowable extent of erosion is substantially improved.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENT

Figure 1:
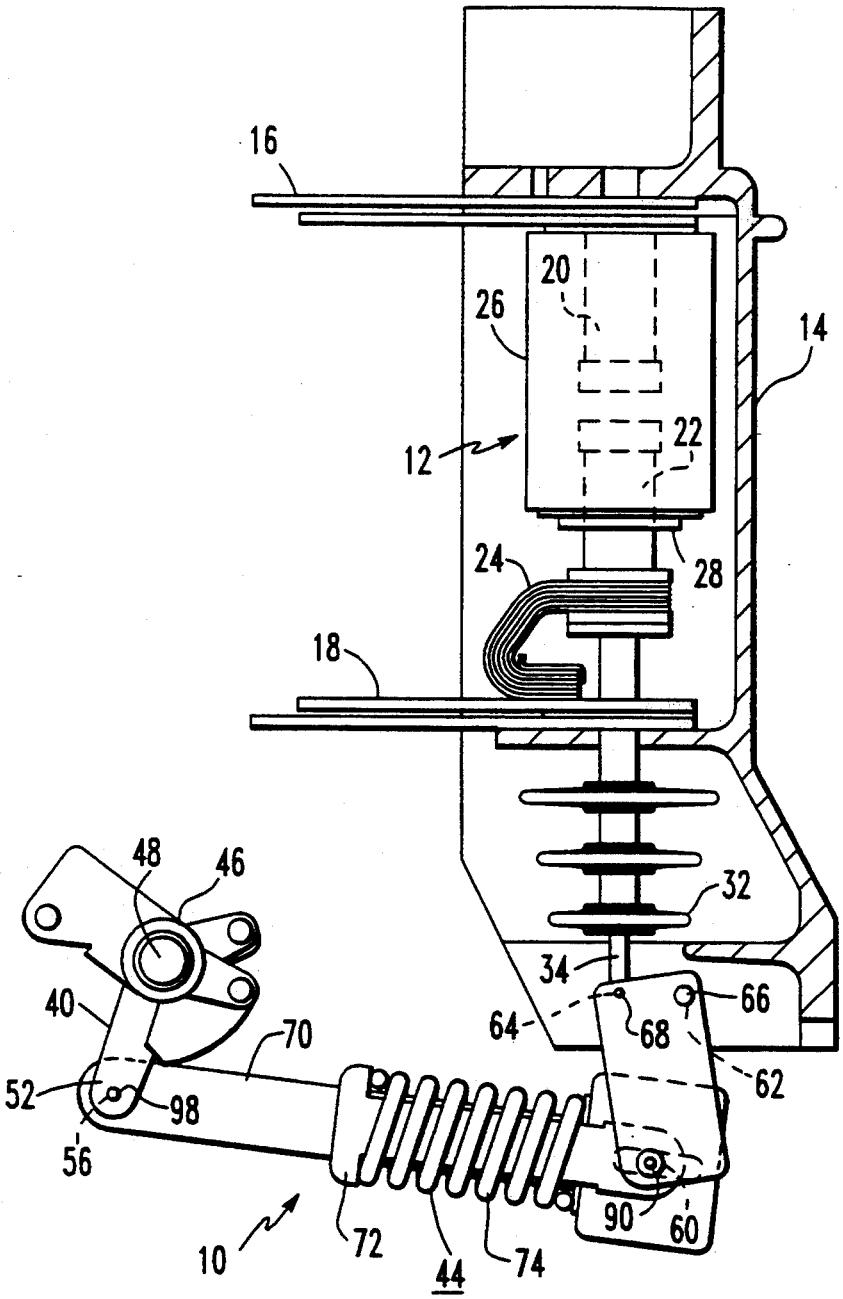
FIG. 1 is a side elevation view, partly in section, showing a drive mechanism according to the present invention, with a vacuum interrupter in the open contact position, shown to illustrate the operative environment.
Figure 2:
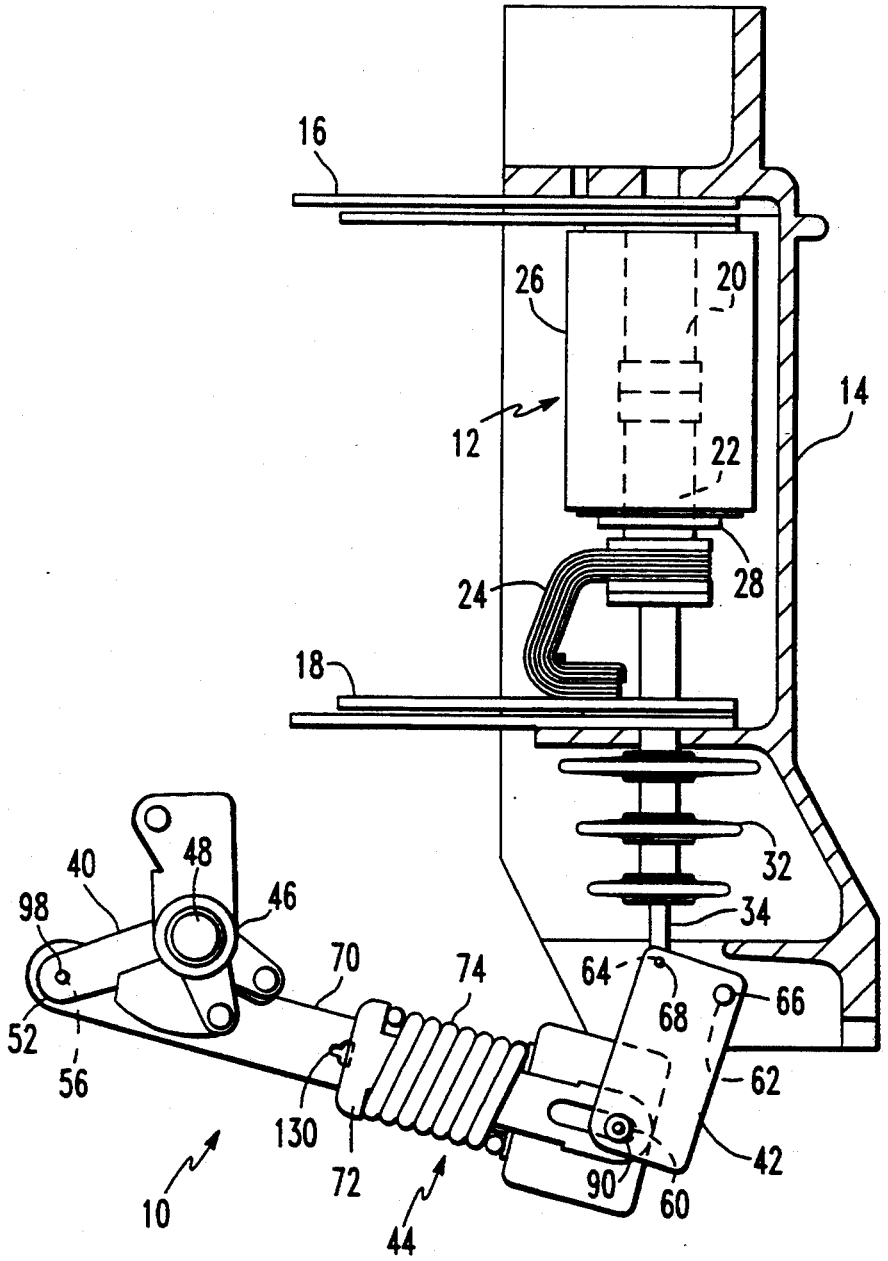
FIG. 2 is a view corresponding to FIG. 1, except that the vacuum interrupter is shown in a closed position.

FIGS. 1 and 2 show a drive mechanism 10 according to the invention, mounted below a vacuum-sealed circuit interrupter 12. The drive mechanism 10 and the circuit interrupter 12 are both mounted to an insulating support structure 14, for example of glass-polyester. The support structure 14 further provides support to upper and lower conductive bus bars 16 and 18. The bus bars 16 and 18 electrically interconnect the opposite contacts of circuit interrupter 12 between the source-side and load-side of an electrical power distribution network such as a typical 15 KV substation. The support structure 14 extends upwardly and downwardly to upper and lower anchor points (not shown), where the interrupter is mounted to a stationary underlying structure. For purposes of this disclosure, terms such as "upper" and "lower" have been used for convenience in discussing the embodiment shown in the drawings. It will be appreciated, however, that the interrupter can be mounted in any orientation and such terms are exemplary rather than limiting.

The circuit interrupter 12 comprises a stationary contact 20 and a movable contact 22. The stationary contact 20 is fixed to the upper bus bar 16 and electrically connected thereto. The movable contact 22 is supported to reciprocate up and down relative to the stationary lower bus bar 18, being guided to move along a line defined by openings in the support structure, the lower bus bar 18 and the bottom wall of the vacuum interrupter vessel or housing 26. An electrical connection is made between the movable contact 22 and lower bus bar 18 by a flexible copper line 24.

The contacts 20 and 22 are maintained in a protective environment by vacuum vessel 26. The vacuum vessel 26 generally comprises electrically insulating glass-polyester walls and is evacuated or contains a gas that is unlikely to ionize. The vacuum vessel 26 has an upper port (not shown) permitting the stationary contact 20 to pass through for electrically coupling with the upper bus bar 16. The stationary contact 20 and the vacuum vessel 26 can be sealed together in known fashion such as by a resilient bushing (not shown).

The vacuum vessel 26 also has a lower port permitting the movable contact 22 to pass through for up and down reciprocation. To seal in the vacuum, a flexible bellows 28 engages between the wall of the stationary vacuum vessel 26 and the movable contact 22. The movable contact 22 extends to a lower end secured to a glasspolyester insulator 32, which insulates the mechanical linkages from the lower bus bar 18. The insulator 32 has a lower end secured to a stem 34 that is pivotally attached to the lever 42. The stem 34 can be metallic because the insulator 32 electrically isolates the stem 34 from bus bar 18.

The drive mechanism 10 comprises a crank 40, a lever 42, and a resiliently extendible connecting rod assembly 44. The crank 40 has a hub 46 provided with a central aperture. The central aperture of the hub 46 is sized for receiving a drive shaft 48. The crank 40 and drive shaft 48 are rotationally fixed together, such as by welding, splines or the like such that the crank 40 rotates on the axis defined by the drive shaft 48, which axis is fixed relative to the mounting structure 14.

The drive shaft 48 is driven in flip-flop fashion in the clockwise and counterclockwise direction by an external force as is known in the art. This force could be produced by a lever, a motor or solenoid, a hydraulic, pneumatic or explosive driver, or could be transmitted by a mechanical linkage coupled to other interrupters that are ganged to that shown.

The hub 46 supports several arms extending radially from the rotation axis, including a main arm 52 and some secondary arms. The main arm 52 extends from the hub 46 to a distal end having an aperture for receiving a pivot pin whereby the arm 52 is pivotally attached to the connecting rod assembly.

On the opposite end of the connecting rod assembly, the lever 42 is provided with first, second and third apertures 60, 62 and 64. Lever 42 is pivotally attached to the mounting structure at aperture 62 by a pivot post 66. The pivot post 66 is fixed in position on the mounting structure 14, and thus defines a point that is fixed relative to the axis defined by drive shaft 48. The other two pivot points, namely of apertures 60 and 64, vary in position with operation of the device. Aperture 64 is pivotally engaged at the lower end of the stem 34 by means of a pivot pin 68 linking with the lever 42. Aperture 60 receives a pivot pin 90 that couples lever 42 to the connecting rod assembly.

The connecting rod assembly 44 interconnects between the crank 40 at pivot aperture 56 and lever 42 at pivot aperture 60. The connecting rod assembly 44 comprises a crank-driven link portion 70, a lever-driving link portion 72, and a coil compression spring 74.

Figure 3:
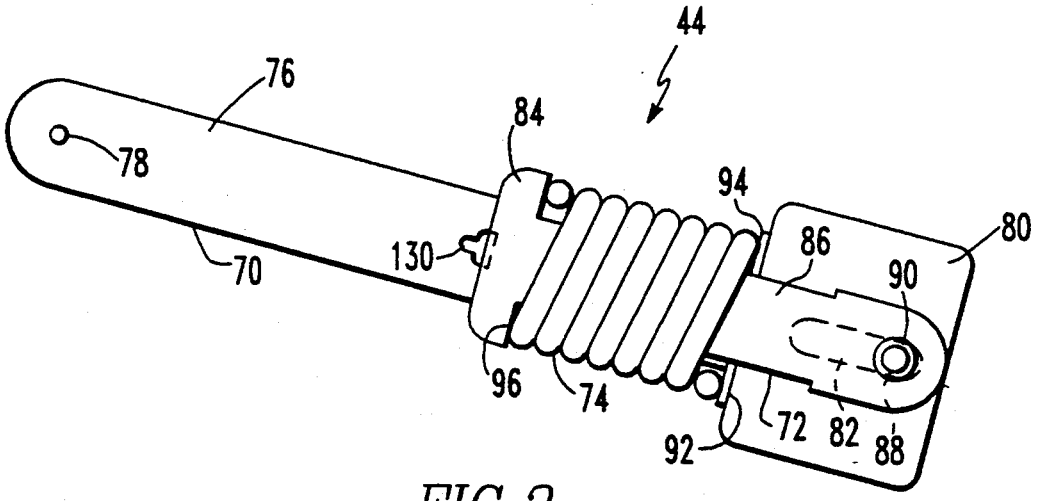
FIG. 3 is an enlarged side elevation view of a resiliently extended connecting rod assembly of the drive mechanism, shown in a position typical of when the contact surfaces are uneroded.
Figure 4:
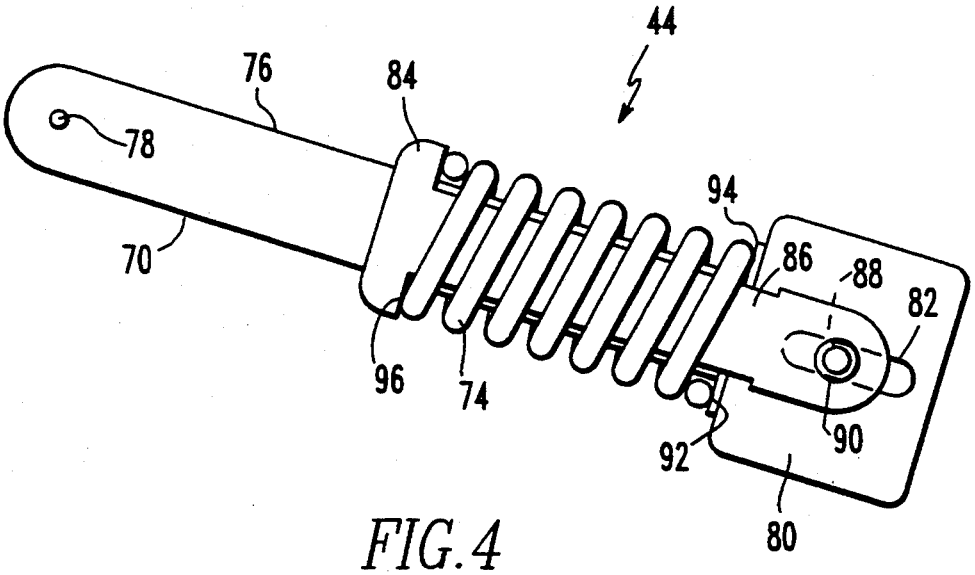
FIG. 4 is a view similar to FIG. 3 except that the resilient extension of the connecting rod assembly is relatively less, as typical of when the contact surfaces are relatively eroded; and, FIG. 5 is an enlarged side elevation view of the contacts of the vacuum interrupter, showing their like-new condition in solid line and an eroded condition in broken lines.

FIGS. 3 and 4 show the connecting rod assembly alone. The crank-driven link 70 has a shank 76 provided with an aperture 78 at which link 70 attaches to the arm of crank 40 and an enlarged opposite end 80. End 80 is a rigidly attached portion of crank-driven link 70, and is provided with a slot 82 extending in the longitudinal direction of the connecting rod assembly (left to right in FIGS. 3 and 4). This slot provides a range of displacement for the other link portion 72 relative to link portion 70, and it is link portion 72 that pivotally couples to the lever 42.

The lever-driving link portion 72 has a first end defining a yoke 84 and a pair of opposite extensions 86 extending away from the yoke 84 to define a second end. The extensions 86 have apertures 88 through the second ends.

The yoke 84 is recessed through with a longitudinal, e.g., rectangular opening (not shown) sized for removably receiving the shank 76 of the crank-driven link 70. The shank 76 of the crank-driven link 70 has a corresponding rectangular section sized for freely reciprocating in the rectangular opening of the yoke 84. The aperture 78 through the shank 76 of the crank-driven link 70 generally remains at a space from the closest part of yoke 84, as shown in FIGS. 3 and 4.

The opposite extensions 86 of the lever-driving link 72 flank the crank-driven link 70 such that the apertures 88 are generally aligned with the slot 82. The apertures 88 support a sliding pin 90 that is carried in slot 82. The ends of slot 82 thereby fix the maximum and minimum length between pivot apertures 78, 88 of the connecting rod assembly. The compression spring seeks to keep the connecting arm as short as possible, by urging link 72 and pivot point 88 thereof in the direction of the crank 40.

The shank 76 and the enlarged end 80 of the crank-driven link 70 cooperatively define a shoulder 92, bearing inwardly on one end of the compression spring, namely against a ring 94. The ring 94 has a central aperture that permits the extensions 86 of the lever-driving link 72 as well as the shank 76 of the crank-driven link 70 to pass through. The ring 94 provides an abutment surface facing away from the shoulder 92. The yoke 84 defines an opposing abutment surface 96, opposed to the ring 94, and bears inward on the opposite side of the spring 74.

The compression spring 74 thus has opposite ends bearing outwardly against the abutment surface 96 and ring 94, respectively. The compression spring 74 defines a cylindrical opening sized to permit the shank 76 of the crank-driven link 70 and the extensions 86 of the lever-driving link 72 to pass through.

The connecting rod assembly attaches to the mechanism of the invention at pivot apertures 78 and 88, and thus is a resilient element whose length can be increased by tension, up to the distance defined by slot 82. Returning to FIGS. 1 and 2, a pivot pin 98 through aperture 78 pivotally interconnects the connecting rod assembly 44 with the aperture 56 of the crank 40. At the opposite end, the sliding pin 90 in pivot aperture 88 pivotally attaches the connecting rod assembly 44 with the first aperture 60 of the lever 42.

The apparatus functions as follows, moving between the open position shown in FIG. 1, wherein the contacts 20 and 22 are spaced apart, and the closed position of FIG. 2, wherein the circuit interrupter 12 is closed and the contacts 20 and 22 are pressed together in abutting engagement. The external force exerted on the mechanism by rotation of the drive shaft 48 flip-flops the drive shaft 48 between clockwise and counterclockwise rotational positions. The rotation of the drive shaft 48 preferably is limited between clockwise-facing and counterclockwise-facing stops (not shown). The drive mechanism 10 responsively drives the movable contact 22 reversibly between the open position (FIG. 1 ) and closed position (FIG. 2).

The drive shaft 48 is driven conventionally. The drive shaft 48 may be driven with the assistance of tension springs (not shown), electrical or fluid driven extension/retraction cylinders, or other force exerting devices. The purpose behind the force exerting devices, which can be triggered in the event of overloads, controlled by a load shedding and load resuming controller or other automatic means, is to bring about the desired operating parameters of the circuit interrupter 12. It is typically desirable to have quick-to-make and quick-to-break action. For example, known force exerting means for the drive shaft 48 can typically drive the movable contact 22 from the closed position (FIG. 2) to the open position (FIG. 1) in about 10 milliseconds.

It is desirable to mechanically bias the closed engagement between the contact surfaces 20 and 22 (as in FIG. 2) under a positive static load of, for example, 900 pounds. One of the purposes of the compression spring 74 is to facilitate this static load. For this purpose, FIG. 1 shows the compression spring 74 while the circuit interrupter 12 is in the open position. FIG. 2 shows the compression spring 74 while the circuit interrupter 12 is in the closed position. Comparison shows the extent of compression of the compression spring 74. Compression is achieved by squeezing the compression spring 74 between the abutment surface 96 and ring 94. The yoke 84 is permitted to move toward the ring 94 (i.e., compare the relative positions between FIGS. 1 and 2) because the sliding pin 90 is slidable in the slot 82 (see FIG. 4).

Figure 5:
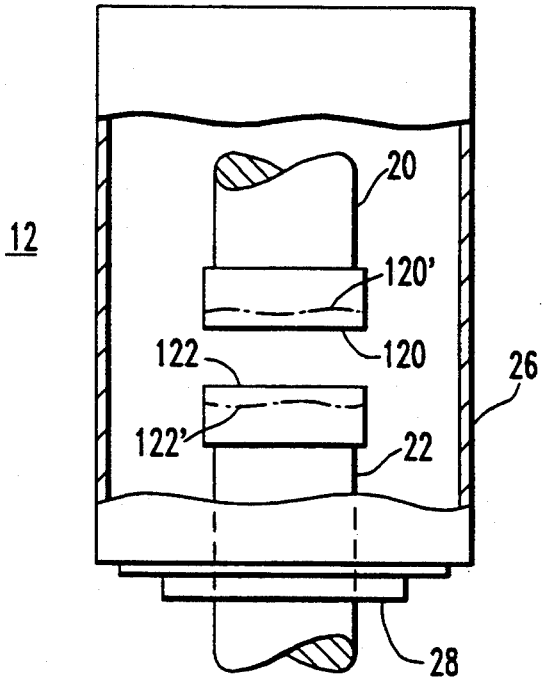

FIG. 5 shows the stationary and movable contacts 20 and 22 in spaced relation to each other, as similar to FIG. 1. The contacts 20 and 22 have contact surfaces 120 and 122 in a like-new condition. More specifically, the contact surfaces 120 and 122 have not yet been worn away because of use.

While the circuit interrupter 12 is in the closed position (FIG. 2), the contact surfaces 120 and 122 are mechanically pressed together in abutting engagement. Preferably, the contact surfaces 120 and 122 are maintained in engagement under about a 900 pound or so static load. The static load is achieved by compression of spring 74, which at the extent of compression shown exerts the required force. The static loading overpowers the tendency of an electric-current induced repelling force to repel the contact surfaces 120 and 122 away from each other. During an interruption, the contact surface 122 of the movable contact 22 moves away from the contact surface 120 of the stationary contact 20 to the open position (as shown by FIGS. 1 and 5).

During high current interruptions, the contact surfaces 120 and 122 erode away from their like-new condition, even under protection of vacuum vessel 26. After repeated high current interruptions, erosion of the contacts 120 and 122 appears as shown in broken lines 120' and 122' (FIG. 5). This changes the dimensions of the arrangement in that the distance between pivot point 64 and the top portion of the supporting structure adjacent upper bus bar 16 is now shorter when the movable contact 122 is bearing against the fixed contact 120.

The added span at which the compression spring 74 exerts sufficient static loading force between the contacts 120, 122 can be up to the span of slot 82, assuming the spring exerts a more than sufficient force when the contacts are new. Accordingly, the arrangement enables continued operation as the contacts wear, without potentially damaging reduction in the force at which the contacts are urged toward one another. The contacts 120 and 122 will need repair or replacement eventually, e.g., after the contact faces have retreated back several millimeters, but meanwhile are reusable.

FIG. 5 shows a gap between contact surfaces 120 and 122 of about 14 millimeters or so. For a gap of 14 millimeters, the mechanical properties of the compression spring 74 are selected to store and maintain a static load of about 900 pounds to the closed engagement between the contacts 20 and 22 (see FIG. 2). As the like-new condition of the contact surfaces 120 and 122 begins to erode, the distance of travel of the movable contact 22 between the open position (FIGS. 1 and 5) and the closed position (FIG. 2) correspondingly increases according to the spring constant of compression spring 74.

As the distance of travel increases, the compression spring 74 will be compressed to a relatively less extent when the contact surfaces 120' and 122' are engaged in the closed position. FIG. 3 shows the compression spring 74 compressed when the circuit interrupter 12 is in the closed position (FIG. 2) and the contact surfaces 120 and 122 are in their like-new condition. FIG. 4 shows the compression spring 74 compressed when the circuit interrupter 12 is closed but the contact surfaces 120' and 122' are relatively eroded. Comparison of FIG. 3 relative to FIG. 4 shows relatively less compression. The compression spring 74 compensates for the erosion between the contact surfaces 120' and 122'. FIG. 4 represents a closed interrupter mechanically loaded under a positive static load in an amount relatively less than the 900 pounds of FIG. 3. Although relatively less, the amount of the positive static load for FIG. 4 is still sufficient for mechanically overcoming the current-induced repulsion between contact surfaces 120' and 122'.

As shown in FIGS. 2 and 3, the connecting rod assembly can be marked to show visually the extent to which the contacts have eroded. A T-shaped indicia 130 is provided on the shank 76 of the crank-driven link 70 of the connecting rod assembly 44 for this purpose. As the contacts wear, the end 84 of the link portion 86 moves closer to the indicia when the contacts are closed. This T-indicia 130, or a similar indicia or series of indicia, provides a visual indication of the extent of erosion between the contact surfaces 120 and 122 and can be positioned at an appropriate position to indicate that wear has proceeded to the point that the contacts should be replaced (i.e., when the indicia is at a predetermined space from the end or is covered). In FIG. 3, where the contacts are new, the indicia is visible. In FIG. 4, where the contacts are worn, the indicia is covered and the contacts should be replaced.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A drive mechanism for a circuit interrupter that has a movable contact and a stationary contact, the drive mechanism comprising:

a crank defining a pivot point and a rotation point at which the crank is rotatably mounted to a mounting structure, the rotation point being spaced from the pivot point;

a lever defining a first pivot point, a spaced second pivot point at which the lever is pivotally mounted on the mounting structure spaced from the crank rotation point, and a third pivot point at which the lever is operably interconnected with the movable contact;

a connecting rod defining spaced opposite pivot points at which the connecting rod is pivoted to the crank pivot point and lever first pivot point respectively so that rotation of the crank drives the lever to move the movable contact into and out of engagement with the stationary contact, the connecting rod comprising a first link having an abutment surface and a second link having an abutment surface; and, biasing means associated with the connecting rod for yielding as the movable contact is driven into engagement with the stationary contact and for releasably maintaining a mechanical static load of a selected amount on the engagement between the movable and stationary contact, the biasing means having spaced ends;

wherein the first and the second links partly overlap one another such that each of the abutment surfaces opposes the other of the abutment surfaces and engages one of the spaced ends of the biasing means; and, coupling means for slidably coupling the first and second links together;

wherein the coupling means includes an elongated slot recessed through the first link and a sliding pin supported by the second link and disposed through the slot.

2. The drive mechanism of claim 1, wherein the crank is pivotable over a substantially fixed angular span.

3. The drive mechanism of claim 1, wherein the biasing means includes a coil spring, and wherein the selected amount of the mechanical static load is about 900 pounds.

4. The drive mechanism of claim 1, wherein the lever and movable contact are operatively coupled via means comprising a stem pivoted to the lever at one end and fixed to the movable contact at an other end.

5. The drive mechanism of claim 1, wherein rotation of the crank is powered by an externally driven rotatable drive shaft defining an axis of rotation.

6. A drive mechanism for a circuit interrupter that has a reciprocating contact and a stationary contact, the drive mechanism comprising:

a crank and a lever mounted relative to a mounting structure at spaced apart fixed axes, the lever being coupled to linearly displace the reciprocating contact for driving the reciprocating contact into and out of engagement with the stationary contact;

a connecting rod assembly pivoted to the crank and to the lever, for transmitting rotational displacement of the crank to pivoting of the lever and displacement of the reciprocating contact, and wherein the connecting rod assembly transmits a tension load to the reciprocating contact when driven into engagement with the stationary contact, the connecting rod assembly comprising a first link having an abutment surface and a second link having an abutment surface; and, a biasing means coupled to the connecting rod assembly for resiliently applying the tension load, the biasing means having a span of extension and retraction under the tension load and being operable to store and maintain a mechanical static load of a selected amount on the reciprocating contact while the reciprocating contact is engaged with the stationary contact, the biasing means having spaced ends:

wherein the first and the second links partly overlap one another such that each of the abutment surfaces is spaced from the other of the abutment surfaces and engages one of the spaced ends of the biasing means; and, coupling means for slidably coupling the first and second links together;

wherein the coupling means includes an elongated slot recessed through the first link and a sliding pin supported by the second link and disposed through the slot.

7. The drive mechanism of claim 6, wherein the crank is pivotable to a substantially fixed angular extent.

8. The drive mechanism of claim 7, wherein the lever and the movable contact are operatively coupled by means comprising a stem pivoted to the lever at one end and fixed to the movable contact at an other end.

9. The drive mechanism of claim 6, wherein the biasing means includes a coil spring, and the selected amount of the mechanical static load is about 900 pounds.

10. A drive mechanism for a circuit interrupter that has a reciprocating contact and a stationary contact, the drive mechanism comprising:

a crank rotatable on a fixed a pivot, with an arm extending radially from the pivot, and means for rotating the crank over a span of angular displacement;

a lever pivotally attached to the mounting structure at a fixed axis spaced from the pivot of the crank, the lever being pivotally attached to means displacing the reciprocating contact with rotation of the lever on the fixed axis; and, a connecting rod assembly pivotally coupled to the lever, the connecting rod assembly comprising a first link having an abutment surface spaced in opposition to a pivotal connection between the connecting rod assembly and the crank, a second link having an abutment surface spaced in opposition to a pivotal connection between the connecting rod assembly and the lever, and a resiliently extendible and retractable member having opposite ends;

wherein the first and the second links partly overlap one another such that each of the abutment surfaces opposes the other of the abutment surfaces and engages one of the opposite ends of the resilient member; and, coupling means for slidably coupling the first and second links together;

wherein the coupling means includes an elongated slot recessed through the first link and a sliding pin supported by the second link and disposed through the slot.

11. The drive mechanism of claim 10, wherein the resilient member comprises a compression spring.

12. The drive mechanism of claim 10, wherein the sliding pin pivotally connects the second link and the lever.

13. The drive mechanism of claim 10, wherein the means for rotating the crank comprises a rotating drive shaft on a fixed axis of rotation.

14. The drive mechanism of claim 10, wherein the resilient member stores a mechanical load for maintaining a positive static load of a selected amount on the reciprocating contact while the reciprocating contact is engaged with the stationary contact.

15. The drive mechanism of claim 14, wherein the selected amount is about 900 pounds.

16. The drive mechanism of claim 15, wherein:

the crank is pivotable over a substantially fixed angular span.

* * * * *